US007724151B2

(12) United States Patent
Taberski et al.

(10) Patent No.: US 7,724,151 B2
(45) Date of Patent: May 25, 2010

(54) SMOKE ALARM SYSTEM

(75) Inventors: Jens Taberski, Stuhr (DE); Klaus Schmötzer, Stuhr (DE)

(73) Assignee: Airbus Deutschland GmbH (DE)

( * ) Notice: Subject to any disclaimer, the term of this patent is extended or adjusted under 35 U.S.C. 154(b) by 309 days.

(21) Appl. No.: 11/572,309

(22) PCT Filed: Jul. 19, 2005

(86) PCT No.: PCT/EP2005/007877

§ 371 (c)(1),
(2), (4) Date: Jan. 18, 2007

(87) PCT Pub. No.: WO2006/008146

PCT Pub. Date: Jan. 26, 2006

(65) Prior Publication Data

US 2008/0094233 A1 Apr. 24, 2008

Related U.S. Application Data

(60) Provisional application No. 60/589,285, filed on Jul. 19, 2004.

(30) Foreign Application Priority Data

Jul. 19, 2004 (DE) ..... 10 2004 034 908

(51) Int. Cl.
*G08B 17/10* (2006.01)

(52) U.S. Cl. ..... 340/628; 340/630; 340/522

(58) Field of Classification Search ..... 340/628–632, 340/521, 522; 348/162, 143, 154
See application file for complete search history.

(56) References Cited

U.S. PATENT DOCUMENTS

| | | | | |
|---|---|---|---|---|
| 4,160,246 | A * | 7/1979 | Martin et al. | 340/630 |
| 5,808,541 | A * | 9/1998 | Golden | 340/286.05 |
| 6,873,256 | B2 * | 3/2005 | Lemelson et al. | 340/539.1 |
| 7,129,848 | B2 * | 10/2006 | Milliot et al. | 340/628 |
| 7,333,129 | B2 * | 2/2008 | Miller et al. | 348/162 |

FOREIGN PATENT DOCUMENTS

CN 2538025 Y 2/2003

(Continued)

OTHER PUBLICATIONS

International Search Report PCT/EP2005/007877 dated Oct. 13, 2005 (European Patent Office NL).

(Continued)

*Primary Examiner*—Anh V La
(74) *Attorney, Agent, or Firm*—Ostrolenk Faber LLP

(57) ABSTRACT

Smoke alarm systems, in particular for an aircraft, advantageously provide a high degree of safety so as to prevent false alarms. According to an embodiment described in this application a smoke alarm system for an aircraft is stated, comprising a camera module, a smoke warning transmitter and a housing. The camera module and the smoke warning transmitter are arranged in the housing. In jointly arranging the camera module and the smoke warning transmitter in one housing, it may become possible to arrange both sensors in one location, which can result in reduced installation expenditure and can make possible direct use of the acquisition signals for local triggering of an alarm.

9 Claims, 2 Drawing Sheets

FOREIGN PATENT DOCUMENTS

| | | |
|---|---|---|
| DE | 391 72 05 | 8/1990 |
| EP | 0 591 585 | 10/1992 |
| EP | 1381005 | 7/2002 |
| JP | 7182579 | 7/1995 |
| JP | 20022367047 | 12/2002 |
| RU | 93 017 737 | 11/1996 |
| WO | WO 02/061702 A1 | 8/2002 |
| WO | WO03/027980 | 6/2003 |

OTHER PUBLICATIONS

Russian Office Action dated Jun. 18, 2009 from counterpart Russian application 2007100151/09.

* cited by examiner

SMOKE ALARM SYSTEM

CROSS REFERENCE TO RELATED APPLICATION

The present application is a 35 U.S.C. §§371 national phase conversion of PCT/EP2005/007877, filed 19 Jul. 2005, which claims the benefit of the filing date of U.S. Provisional Patent Application No. 60/589,285 filed Jul. 19, 2004 and of German Patent Application No 10 2004 034 908.8 filed Jul. 19, 2004, the disclosures of which are herein incorporated by reference. The PCT Application was published in the English Language.

BACKGROUND OF THE INVENTION

1. Field of the Invention

The present invention relates to the detection of a smoke situation or a fire situation in a vehicle, for example in an aircraft. In particular, the present invention relates to a smoke alarm system for an aircraft, as well as to a method for detecting the smoke situation in a space of an aircraft.

2. Technological Background

Presently available smoke warning systems for mobile applications and correspondingly limited installation options (aircraft, railway, submarine etc.) operate with optical smoke warning transmitters. These smoke warning transmitters use the diffused-light principle with a specified alarm threshold. In the case where there is no smoke or there are no particles, the receiver does not receive a signal because there is a barrier between the light source and said receiver. However, if smoke particles (or other particles) are encountered in this region, then the light is diffused and the receiver registers a corresponding signal rise. If this signal rise exceeds a specified threshold value, the smoke warning system issues an alarm, for example an intermittent light signal at some other location, or an alarm sound.

However, in a disadvantageous way, all types of aerosols, i.e. not only smoke particles, cause light diffusion and can thus erroneously cause smoke warning transmitters to assume an alarm state. In practical application it has been shown that in such smoke warning transmitters, for example fog, dust or even the use of insecticides can cause false alarms. In most applications such false alarms pose a safety risk; in this context evacuation of aircraft or ships is pertinent.

For this reason it is advantageous to reduce, and there is a need for reducing, the probability of false alarms, which probability at times is more acute in the case of mobile applications due to quickly changing ambient conditions.

SUMMARY OF THE INVENTION

It maybe object of the present invention to make it possible to safely acquire smoke situations.

Smoke situations can for example arise as a result of a fire, a smouldering fire, or smouldering. Melting processes where there are no flames involved can also generate such smoke.

According to one exemplary embodiment of the present invention, a smoke alarm system for an aircraft is provided, which smoke alarm system comprises a camera module, a smoke warning transmitter and a housing. According to one aspect of this embodiment, the camera module and the smoke warning transmitter are arranged in the same housing.

In an advantageous way, the arrangement of the camera module or of a camera and of the smoke warning transmitter, which functions for example according to the diffused-light principle, in a housing can lead to reduced installation expenditure and reduced space requirements. This may particularly be advantageous in conditions of burn-out-proof spaces. Furthermore, improved and safe acquisition of smoke situations can be achieved because the smoke warning transmitter and the camera module essentially have the same perspective.

According to a further exemplary embodiment of the present invention, the camera module and the smoke warning transmitter are designed such that they can be connected to a single computer unit.

The above may make possible simple processing of the output signals of the camera module and of the smoke warning transmitter by means of a single computer unit, for example a centrally arranged computer unit, wherein for example the provision of individual computer units, one for the camera module and one for the smoke warning transmitter, becomes obsolete.

According to a further exemplary embodiment of the present invention, the camera module, the smoke warning transmitter or the housing are designed to be affixed to a cabin roof region of the aircraft.

As a result of the perspective or view from above into the region to be monitored, in many cases areas that are not visible or blind spots can be reduced in size. Furthermore, any problem due to edges or projections which would cause coverage gaps resulting from load situations is reduced.

According to a further exemplary embodiment of the present invention, the camera module or a corresponding camera comprises a fisheye lens which makes it possible to monitor a large region by means of a single smoke alarm system.

According to a further exemplary embodiment of the present invention, the camera module comprises a lens with a characteristic. The computer unit is designed to at least partly compensate for the characteristic of the lens. For example, if the camera module comprises a fisheye lens, the computer unit can be designed to compensate, by means of known computing processes, for the distortions generated by the fisheye lens.

According to a further exemplary embodiment of the present invention, the camera module and the smoke warning transmitter are equipped to communicate with the computer unit by way of a network to which the camera module and the smoke warning transmitter can be connected. Advantageously this makes it possible for the provision of only one network to be sufficient to interconnect the camera module, the smoke warning transmitter and the computer unit.

According to a further exemplary embodiment of the present invention, the smoke alarm system is equipped for acquiring a smoke situation in a space in an aircraft. An imaging region, i.e. a region within the field of view of the camera of the camera module, is equipped such that if the smoke alarm system is arranged in a central region of the ceiling of the space, then a floor area of the space is covered. In an advantageous manner, for example the imaging region of the camera can be adapted by means of suitable lenses. Also in an advantageous manner, the imaging region covers the entire floor area of the space.

In an advantageous manner, in this way the floor area of the space can safely be monitored by means of a smoke alarm system.

According to a further exemplary embodiment of the present invention, a method for acquiring a smoke situation in a space in an aircraft is stated, in which method a smoke alarm system comprising a camera module and a smoke warning transmitter, both arranged in a housing, is provided. By means of the camera module, an image of the space is taken. By means of the smoke warning transmitter, particles in the air in the space are acquired. In this context it should be pointed out that the term particles can comprise not only smoke particles but also aerosols. The result of acquiring the smoke warning transmitter is compared to the image. For example, in this manner it can be detected that—for example in a fog situation in which as a result of the large number of particles (water droplets) in the air the smoke warning transmitter would acquire an alarm situation—there is merely fog, and the issuing of an alarm can be prevented. According to the method of this embodiment, an alarm is issued on the basis of the comparison result of the image, and the acquisition of the particles.

According to a further exemplary embodiment of the present invention, the image and the acquisition of the particles are adjusted or evaluated by means of a single computer unit.

According to a further exemplary embodiment of the present invention, the image of the space is taken from above, for example from a ceiling region of the space, wherein an image region of the image covers a floor area of the space.

BRIEF DESCRIPTION OF THE DRAWINGS

Below, with reference to FIGS. 1 to 3, advantageous embodiments of the present invention are described.

DETAILED DESCRIPTION OF EXEMPLARY EMBODIMENTS

In the following description of FIGS. 1 to 3, identical reference numbers are used for identical or corresponding elements.

Figure 1:
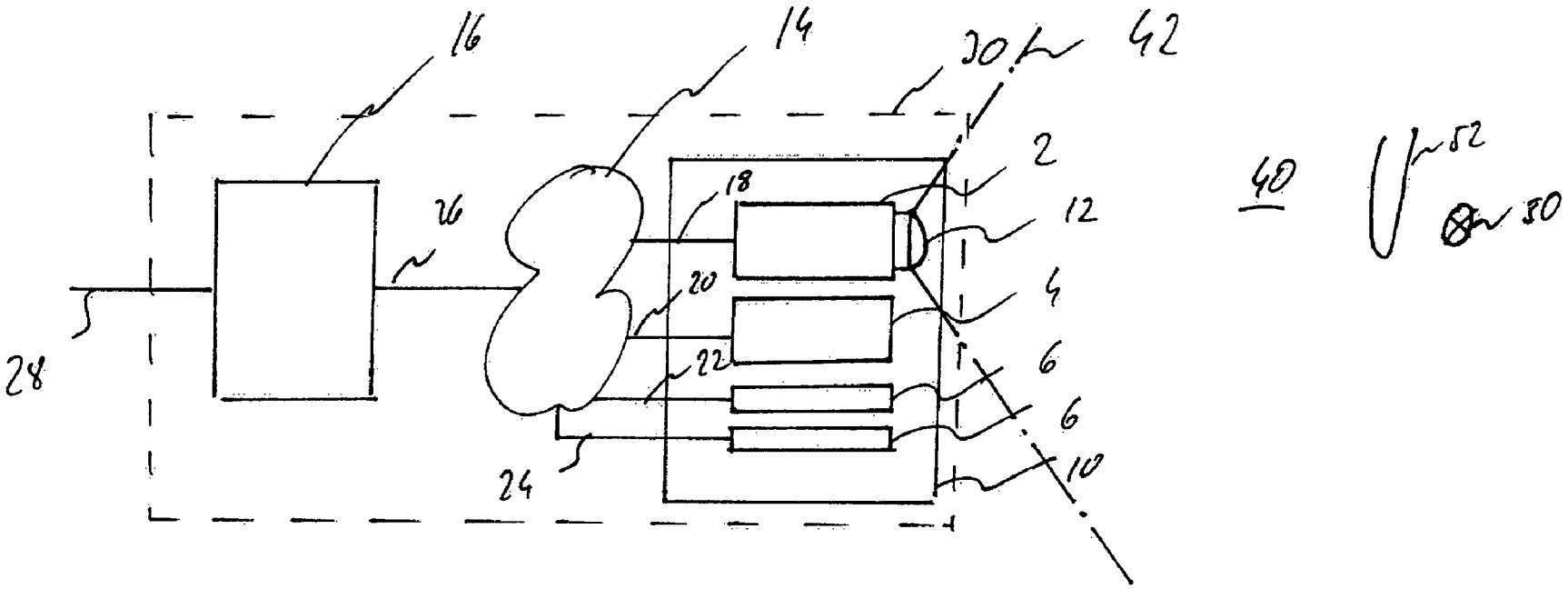
FIG. 1 shows a simplified schematic diagram of an embodiment of a design of a smoke alarm system according to the present invention.

FIG. 1 shows a simplified logic diagram of a smoke alarm system of an exemplary embodiment of the present invention. Reference number 2 designates a camera module comprising for example a CCD camera. The camera module 2 comprises a lens or lens system 12 which helps determine an image region or field of view 42 of the camera module 2. For example, by means of a fisheye lens or a wide angle lens the field of view 42 can be widened. By means of a lens which has a greater focal length, for example by means of a telephoto lens, the image region or the field of view of the camera module 2 can also be focussed on particular points.

Reference number 4 designates a smoke warning transmitter which operates for example on the basis of the diffused-light principle with a specified alarm threshold. In the case where there is no smoke and there are no particles in the space, the receiver of the smoke warning transmitter 4 does not receive a signal because there is a barrier 52 between the light source 50 and said receiver of the smoke warning transmitter 4. However, if smoke particles (or other particles, such as for example aerosols) are encountered in this region, the light is diffused and the receiver registers a corresponding signal rise. If this signal rise exceeds a specified threshold value, then the smoke warning transmitter issues an alarm.

As has already been discussed, this functional principal can be confused in that not only smoke particles but all types of aerosols cause light diffusion and can thus cause the smoke warning transmitter to assume an alarm state. In practical application it has been shown that for example fog, dust or even the use of insecticides can cause false alarms.

Reference characters 6 designate a humidity sensor and/or temperature sensor which can be provided in addition or as an option.

As shown in FIG. 1, the camera module 2 and the smoke warning transmitter 4 are arranged in a housing 10. In an advantageous manner this makes possible a simple installation of the smoke alarm system 40 because for example only one installation location needs to be provided and prepared for this, rather than separate installation locations and devices for the camera module 2 and the smoke warning transmitter 4.

The camera module 2 is connected to a data connection 26 by means of a data connection 18 by way of a network 14, wherein said data connection 26 in turn is connected to a computer unit 16. The smoke warning transmitter 4 is connected with a data connection 20 to the network 14 which in turn is connected to the computer unit 16 by way of data connection 26. The temperature of the humidity sensors is connected to the computer unit 16 by way of corresponding data connections 22 and 24 by way of the network 14 and the data connection 26. The computer unit comprises a data output device 28. For example an alarm signal can be output by way of this data output device 28. The data output device 28 can for example be connected by means of a corresponding optical display or acoustic display.

According to the embodiment shown in FIG. 1, a further housing 30 can be provided in which the computer unit 16, the data connections 18, 20, 22, 24, 26, the network 14, the camera module 2, the smoke warning transmitter 4 and the further sensors 6 can be arranged. This makes possible a compact design of the overall system.

However, it should be pointed out that for example the computer unit 16 can also be arranged at some distance for example from the housing 10 of the smoke alarm system. A connection can then be implemented by means of the network 14 and the data connections 18, 20, 22, 24 and 26.

The computer unit 16, which for example comprises a CPU, which computer unit 16 can for example be a commercially available PC, is adapted so that the output signals of the camera module 2 and the output of the smoke warning transmitter 4 are processed. In other words, only one computer unit 16 is provided to process the output signals of the camera module 2 and of the smoke warning transmitter 4. The computer unit 16 comprises means for processing or adjusting the output signals of the camera module 2 and of the smoke warning transmitter 4 together. This is explained below by means of an example.

For example, the smoke warning transmitter 4 would output an alarm signal in a fog situation. However, comparative adjustment of this signal with the image taken by means of the camera module 2, by means of the computer unit 16, shows that only fog is present, while in fact no smoke situation or alarm situation exists. Therefore the output of an alarm signal by means of the alarm output device 28 can be suppressed.

Furthermore, for example, in spite of an alarm acquisition by means of the smoke warning transmitter, it can be detected that for example only insecticide has been sprayed in the cabin or in the cargo compartment of the aircraft. In such a case too, the output of an alarm can be suppressed.

Generally, it can be stated that by acquiring the smoke situation by means of two different acquisition systems, namely by means of the smoke warning transmitter 4 and by means of the camera module 2, and by adjustment or comparison of the respective acquisition results, improved and safe acquisition of smoke situations can be achieved, and the probability of false alarms can be significantly reduced.

Figure 2:
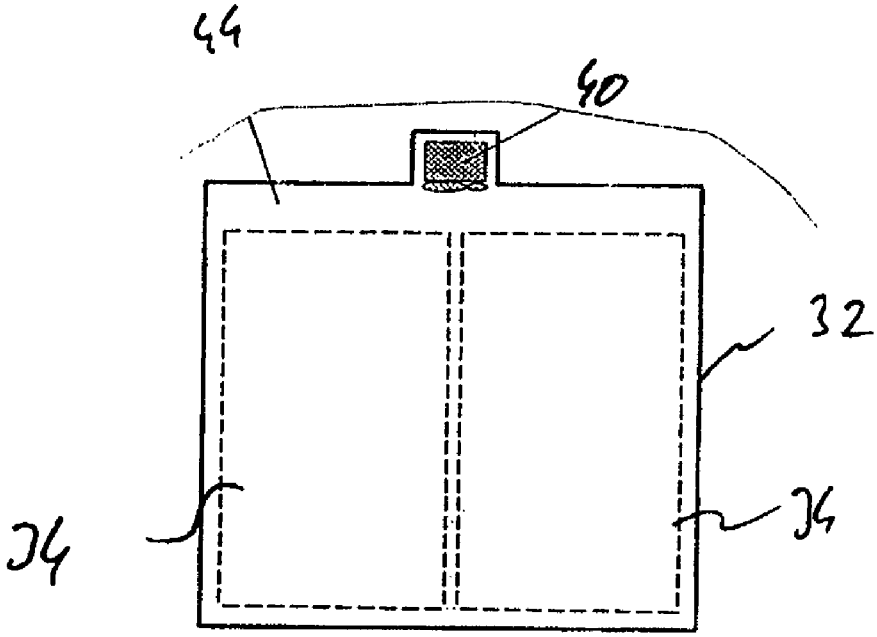
FIG. 2 shows a sectional view for example of a cargo compartment of an aircraft, in which an embodiment of the smoke alarm system according to the invention is arranged according to the invention.

FIG. 2 shows an arrangement according to the invention of a smoke alarm system, for example of the smoke alarm system shown in FIG. 1, in a cargo compartment of an aircraft. As shown in FIG. 2, the walls 32 of the cargo compartment define a space 44 which is filled with air. Reference numbers 34 designate items of freight. In the ceiling region of the cargo compartment a recess is provided in which the smoke alarm system according to the present invention, for example the smoke alarm system shown in FIG. 1, is arranged. In other words, the smoke alarm system according to the present invention is arranged such that it views from above the space to be monitored.

Figure 3:
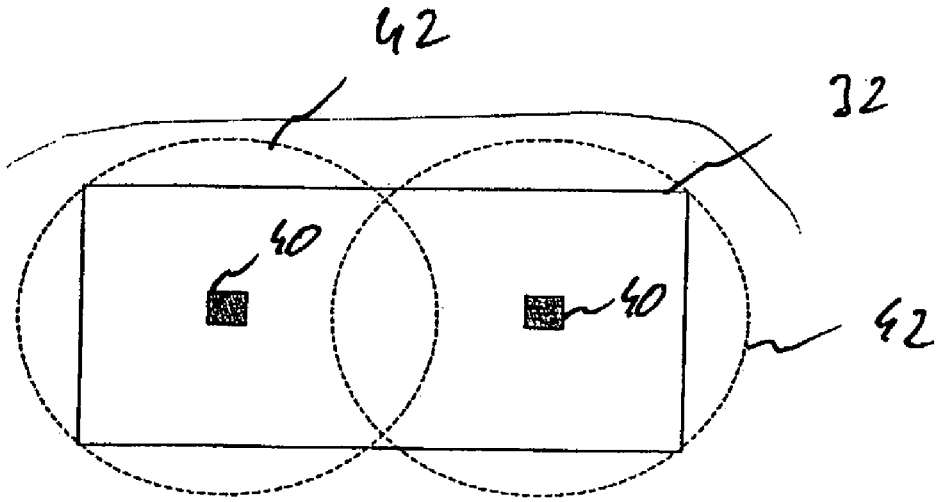
FIG. 3 shows a top view of a space to be monitored, in which according to the invention embodiments of the smoke alarm system of the present invention are arranged.

FIG. 3 shows a top view of the cargo compartment of FIG. 2. As shown in FIG. 3, two smoke alarm systems 40 are provided. Each of the smoke alarm systems 40 comprises a field of view 42. The smoke alarm systems 40 are designed such that the fields of view 42 essentially cover the entire floor area of the cargo compartment so that blind spots, i.e. regions which are not optically covered, are minimised.

Accordingly, it is obvious to the person with technical skills in this field that the smoke alarm system according to the present invention has reduced installation requirements and space requirements, in particular in conditions of burn-out-proof spaces, as a result of minimisation of the number of devices and as a result of using for example a common network that is already in existence and a central computer. Furthermore, in this way for example weight savings can be achieved. Furthermore, synergies, for example through the further arrangement of humidity sensors and temperature sensors between fire smoke warning transmitters and camera modules based on more criteria, can better be used in an improved way. This is for example made possible by the identical installation situation of the smoke warning transmitter 4 and camera module 2. Furthermore, as a result of arranging the camera module 2 and the smoke warning transmitter 4 in a housing 10, all parameters and measured values acquired can be directly used for a local alarm statement. Furthermore, in most cases the view from above into the region to be monitored can make it possible to reduce the size of blind spots. Furthermore, covered regions, which are for example caused by edges or projections or by different loading situations, can in many cases be reduced in size.

As mentioned above, for example the network 14 can be a network which already exists for example in the aircraft. Furthermore, the computer unit 16 can for example be a central computer of an aircraft. In this case of course no common housing 30 (FIG. 1) is provided.

In addition it should be pointed out that "comprising" does not exclude other elements or steps, and "one" does not exclude a plural number. Furthermore, it should be pointed out that characteristics or steps which have been described with reference to one of the above embodiments can also be used in combination with other characteristics or steps of other embodiments described above. Reference characters in the claims are not to be interpreted as limitations.

The invention claimed is:

1. A smoke alarm system for an aircraft, comprising:

a camera module;

an optical smoke warning transmitter; and a housing;

wherein the camera module and the optical smoke warning transmitter are arranged in the housing;

wherein the camera module and the optical smoke warning transmitter are connectable to a computer unit;

wherein the computer unit is adapted for adjusting output signals of the camera module and of the optical smoke warning transmitter.

2. The smoke alarm system of claim 1, wherein the camera module, the optical smoke warning transmitter and the housing are adapted for attachment to a cabin ceiling region of the aircraft.

3. The smoke alarm system of claim 1, wherein the camera module comprises a fisheye lens.

4. The smoke alarm system of claim 1, wherein the camera module comprises a lens with a characteristic;

wherein the computer unit is adapted to at least partly compensate for the characteristic of the lens.

5. The smoke alarm system of claim 1, wherein the camera module and the optical smoke warning transmitter are adapted to communicate with the computer unit over a network to which the camera module and the optical smoke warning transmitter are connectable.

6. The smoke alarm system of claim 1, wherein the smoke alarm system is adapted for detecting a smoke situation in a space in an aircraft;

wherein an imaging region of a camera of the camera module is adapted such that if the smoke alarm system is arranged in a central region of a ceiling of the space, a floor area of the space is covered.

7. The smoke alarm system of claim 2, wherein the camera module comprises a fisheye lens.

8. A method of detecting a smoke situation in a space in an aircraft, comprising the steps of:

Providing a smoke alarm system with a camera module and an optical smoke warning transmitter which are arranged in a housing;

taking an image of the space with the camera module;

acquiring particles in the air in the space with of the optical smoke warning transmitter;

comparing the image of the camera module and the result of the acquisition of the particles of the optical smoke warning transmitter via a single computer unit; and issuing an alarm on the basis of the analysis result.

9. The method of claim 8, further comprising the step of:

taking the image of the space from above, wherein an image region of the image covers a floor area of the space.

* * * * *